US005507628A

United States Patent [19]

Masse et al.

[11] Patent Number: 5,507,628

[45] Date of Patent: Apr. 16, 1996

[54] SUBMERSIBLE PUMP LIFT OUT COUPLING

[76] Inventors: Earl P. Masse, 22088 Kerry Avenue, Maple Ridge, British Columbia, Canada, V2X 0V8; Gordon L. Brusatore, #107-7450 Lowland Drive, Burnaby, British Columbia, Canada, V5J 5A4

[21] Appl. No.: 394,440

[22] Filed: Feb. 24, 1995

[51] Int. Cl.[6] ..... F04B 35/04

[52] U.S. Cl. ..... 417/360; 417/361; 417/423.3; 417/423.15; 248/669

[58] Field of Search ..... 417/360, 361, 417/423.15, 423.3; 248/669, 125

[56] References Cited

U.S. PATENT DOCUMENTS

| | | | |
|---|---|---|---|
| 3,018,925 | 1/1962 | Englesson | 222/180 |
| 3,234,885 | 2/1966 | Englesson | 103/87 |
| 3,427,982 | 2/1969 | Englesson | 103/87 |
| 3,592,564 | 7/1971 | Conery | 417/360 |
| 3,771,914 | 11/1973 | Crespo | 417/360 |
| 3,771,915 | 11/1973 | Back | 417/360 |
| 3,880,553 | 4/1975 | Wolford et al. | 417/360 |
| 3,938,545 | 2/1976 | Nagy et al. | 137/363 |
| 4,060,345 | 11/1977 | Blum | 417/360 |
| 4,178,139 | 12/1979 | Seppanen et al. | 417/360 |
| 4,308,000 | 12/1981 | Oakes | 417/360 |
| 4,392,790 | 7/1983 | Shibata et al. | 417/360 |
| 4,564,041 | 1/1986 | Kramer | 137/565 |
| 4,661,047 | 4/1987 | Weis | 417/360 |
| 4,679,991 | 7/1987 | Harbison et al. | 417/360 |
| 4,886,426 | 12/1989 | Surinak | 417/360 |
| 5,181,841 | 1/1993 | Kirkland | 417/423.3 |

*Primary Examiner*—Charles Freay
*Attorney, Agent, or Firm*—Kolisch, Hartwell Dickinson, McCormack & Heuser

[57] ABSTRACT

A lift out coupling for a submersible pump has a close quarter elbow that connects to an upward facing threaded discharge of standard submersible pumps, and can be rotated in the outlet without interfering with the pump body. In the past, it has been necessary to have an extension pipe that extends down to connect to a threaded outlet with the elbow portion above the pump itself. The coupling has a lift out portion with a close quarter elbow for connection to the threaded discharge and rotatable without interfering with the submersible pump, the elbow has a first sealing flange connected thereto with a lift hook for raising the pump and the lift out portion on guide rails. A fixed portion has a second sealing flange for mating with the first sealing flange, the second sealing flange connected to a discharge elbow forming part of a base support frame for installation in a sump, the frame having guide rails extending upward therefrom in the sump. The lift out portion has a lift out connection to the fixed portion, the connection supporting the lift out portion and the pump and retaining the first sealing flange sealed to the second sealing flange.

16 Claims, 4 Drawing Sheets

FIG. 1
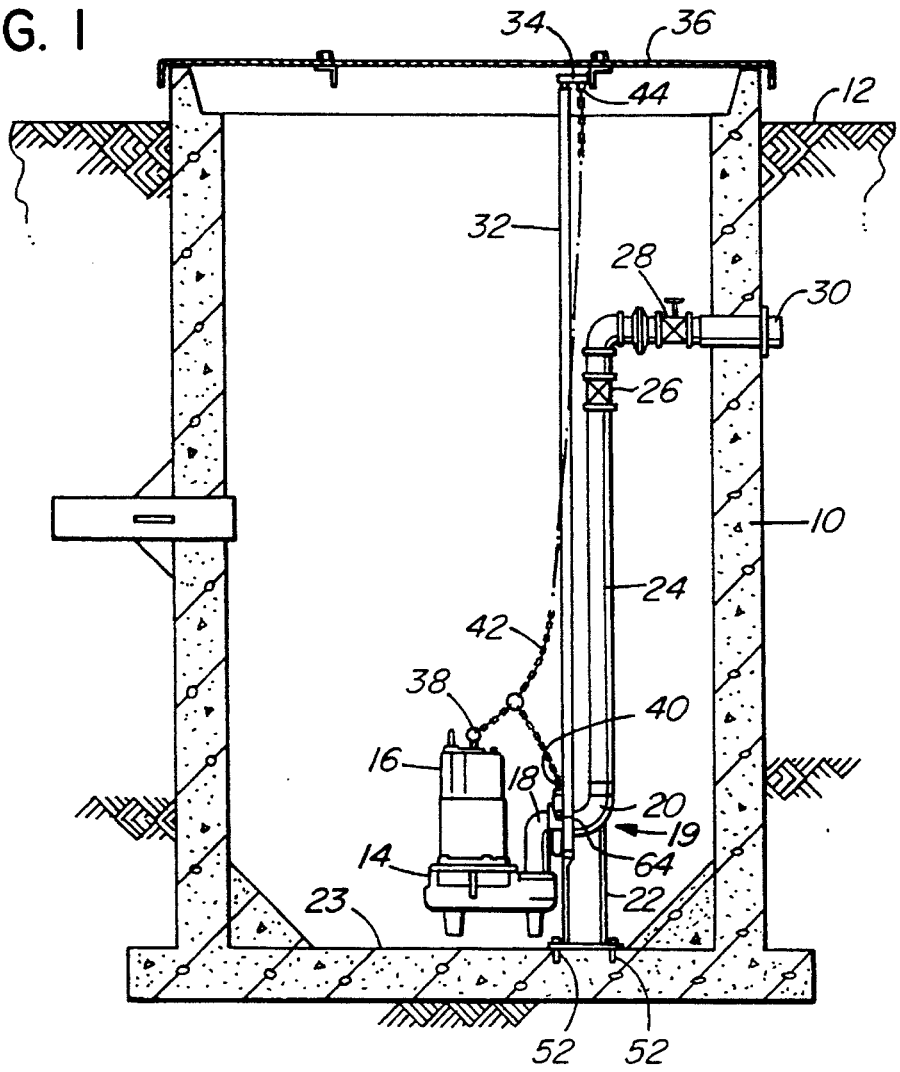
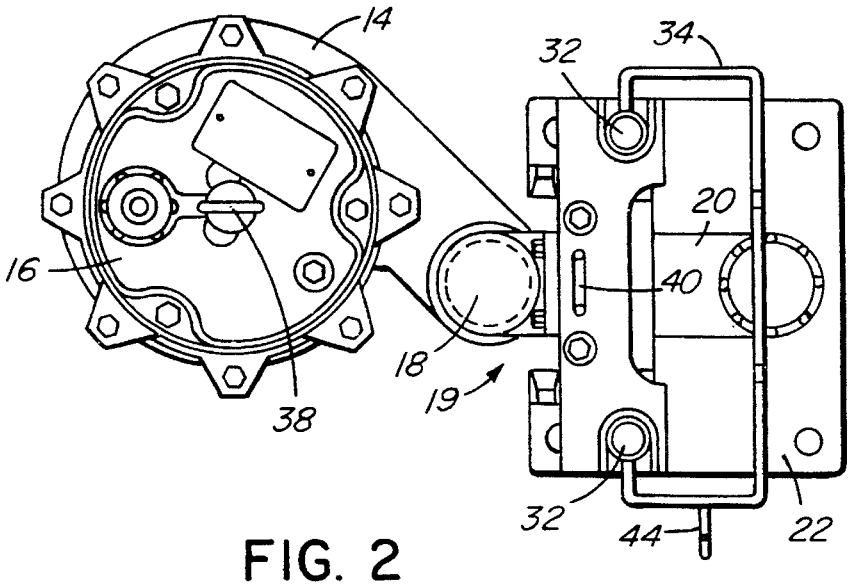
FIG. 2

SUBMERSIBLE PUMP LIFT OUT COUPLING

TECHNICAL FIELD

The present invention relates to submersible pumps and more specifically to a pump lift out system utilizing guide rails and a coupling to permit insertion and removal of submersible pumps.

BACKGROUND ART

Submersible pumps are often installed in underground tanks or sumps that handle hazardous liquids or contaminated liquids such as sewage. In the past, maintenance of such pumps required drainage of the sump followed by a maintenance person descending into the sump to work on the submersible pump. More recently, lift out slide rail systems have been used. These systems have lift out couplings and permit removal of the pumps from sumps or underground tanks without having to drain the sump and without having to conduct maintenance on the pump in place. A coupling is provided which has substantially vertical flanges, one portion of the coupling being connected by pipes to the pump and the other portion of the coupling connected to an outlet pipe extending upwards from the sump. A lifting arrangement is attached to the pump and lift out portion of the coupling so the pump may be lifted out of the sump. As the lift out portion of the coupling moves up, the movable flange breaks away from the opposing fixed flange; the pump is lifted on guide rails and removed from the sump for maintenance. For installation, the pump is lowered on the guide rails until the movable flange of the coupling mates with the opposing fixed flange, thus connecting the pump to the discharge pipe.

In the past a majority of these submersible pumps were specially made with horizontal discharges to match the lift out couplings. Examples of these types of pumps and couplings are shown in U.S. Pat. No. 4,060,345 to Blum, U.S. Pat. No. 4,564,041 to Kramer, U.S. Pat. No. 4,661,047 to Weis and U.S. Pat. No. 4,679,991 to Harbison et. al.

Many submersible pumps have upward discharges with flanged connections and elbows are therefore required to connect the pump to the couplings which generally have mating flanges that are vertical or nearly vertical. Examples of these types of arrangements are shown in U.S. Pat. No. 3,592,564 to Conery and U.S. Pat. No. 4,392,790 to Shibata et. al.

Most standard submersible pumps today are being made with an upward facing threaded discharge, the pipe sizes generally range from 1¼" up to about 3", and in order to use such a pump with a lift out coupling it has been necessary to first of all provide a pipe of sufficient length that it extends above the pump itself, otherwise it has not been possible to screw an elbow into the threaded discharge outlet. An example of such an arrangement is shown in U.S. Pat. No. 4,886,426 to Surinak. The reason the standard elbows cannot be rotated in the threaded outlet is because the standard elbow hits the pump when it is rotated.

When a submersible pump has an extension pipe so the lift out coupling is positioned above the pump, it becomes difficult to keep the pump and coupling in exactly the right attitude when being lowered on guide rails and this can result in difficulties in mating the two halves of the coupling to form a seal.

It is an aim of the present invention to provide a lift out coupling for a submersible pump that connects to an upward facing threaded discharge of standard submersible pumps available on the market today, the coupling arranged to be as close to the upward facing discharge as is reasonably possible and not extending above the pump itself. Furthermore, the coupling is of sufficient strength so that it can support the pump above the base of a tank or sump, thus avoiding difficulties of solid particles on the base causing an obstruction when a pump is replaced.

It is a further aim to provide a lift out coupling for a submersible pump that has a limited number of components and fits standard submersible pumps with upward facing threaded discharges of 1¼", 1½", 2" and 3". Furthermore, the lift out coupling has a close quarter elbow, threaded at one end, that can be screwed into the threaded discharge outlet of the pump and can be rotated in the outlet without interfering with the pump or the motor of the pump.

It is a further aim of the present invention to provide a submersible pump lift out coupling having connection to a lift arrangement such as a lift out chain or the like that can be arranged to hold the pump and coupling substantially level when being raised on guide rails within the sump or tank.

DISCLOSURE OF THE INVENTION

The present invention provides a lift out coupling for a submersible pump with an upward facing threaded discharge, the coupling comprising a lift out portion including a pump outlet close quarter elbow for connection to the threaded discharge and rotatable without interfering with the submersible pump, the elbow having a first sealing flange connected thereto with lifting guide means and attachment means for raising the pump and the lift out portion on guide rails, a fixed portion including a second sealing flange for mating with the first sealing flange, the second sealing flange connected to a discharge elbow forming part of a base support frame for installation in a sump, the frame having the guide rails extending upwards therefrom in the sump, and connection means between the lift out portion and the fixed portion of the coupling to support the lift out portion and the pump and retain the first sealing flange sealed to the second sealing flange.

BRIEF DESCRIPTION OF DRAWINGS

In drawings which illustrate embodiments of the present invention,

FIG. 1 is a sectional elevation showing a sump with a submersible pump and a lift out coupling installed therein, FIG. 2 is a plan view showing the submersible pump and coupling of FIG. 1.

BEST MODE FOR CARRYING OUT THE INVENTION

Figure 3:
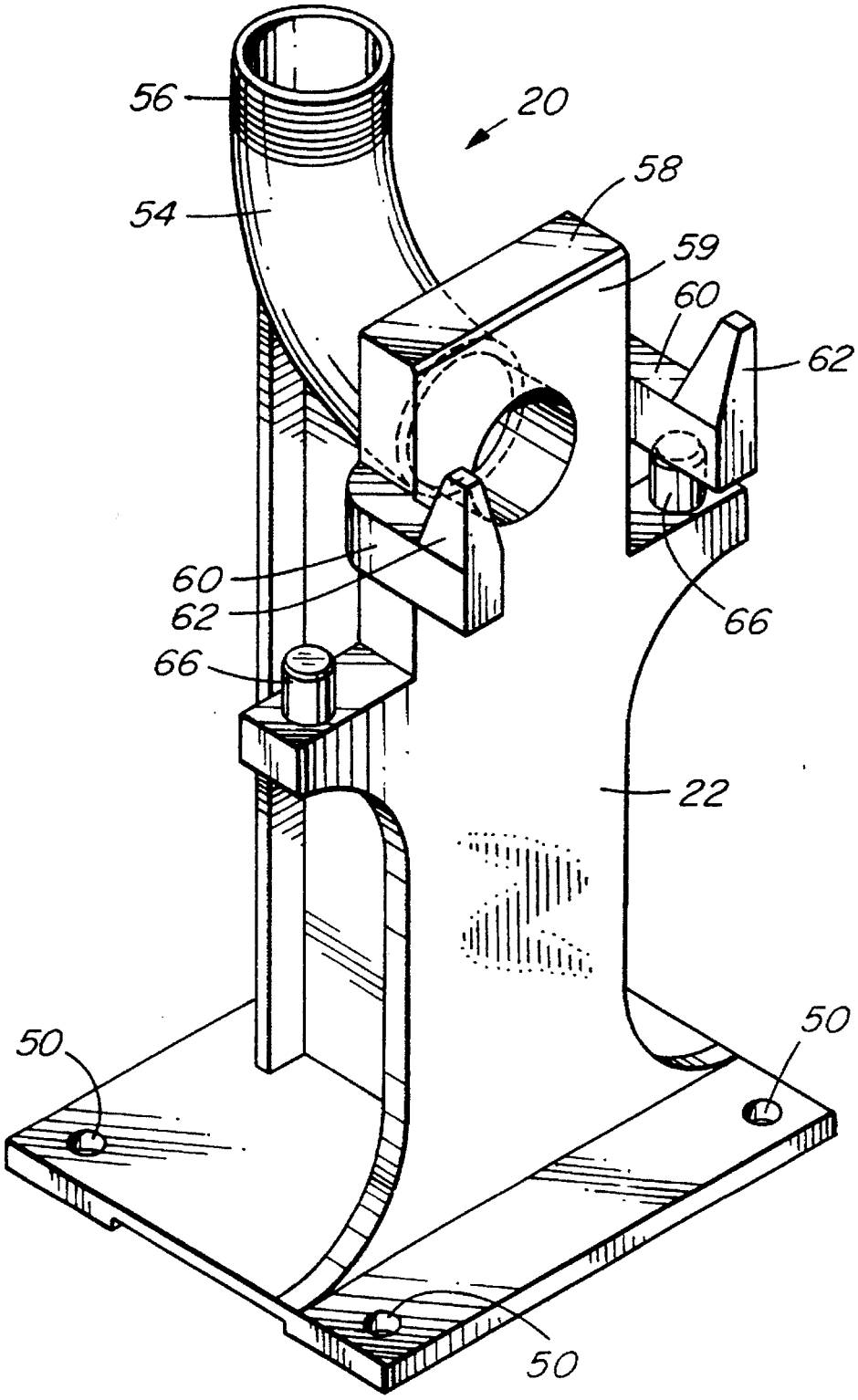
FIG. 3 is an isometric view showing the fixed portion of the lift out coupling of FIG. 1.

A concrete sump 10 is shown in FIG. 1 below ground level 12 with a submerged sump pump 14 driven by motor 16 attached to a lift out portion 18 of a lift out coupling 19 which in turn mates with a fixed portion 20 forming part of a base support frame 22 attached to the base 23 of the sump 10. A discharge pipe 24 extends up from the fixed portion 20 of the lift out coupling 19 and passes through a non-return valve 26, a manual valve 28 to discharge 30 outside the sump 10. The discharge connection is not shown in the drawing.

As may be seen in FIG. 1 and additionally in FIG. 2, two guide rails 32, which in this embodiment are tubular, extend up from the fixed portion 20 of the lift out coupling 19 to a top bracket 34 which in turn is connected to the lid 36 of the sump 10. Thus, the guide rails 32 are fixed within the sump 10 and are supported from the base support frame 22 which in turn supports the fixed portion 20 of the lift out coupling 19.

An eye bolt 38 is provided on top of the pump motor 16 and a further eye bolt 40 is provided on top of the lift out portion 18 of the lift out coupling 19. A chain 42 having two link portions that connect to the two eye bolts 38,40, extends up to a hook 44 from the top bracket 34. The link portions are of a suitable length so that when the chain 42 pulls the pump 14 and lift out portion 18 upwards, they remain substantially level. While not shown specifically in the drawing, an opening, preferably with a cover, is provided in the lid 36 of the sump to permit the pump 14 and lift out portion 18 of the lift out coupling 19 to be removed from the sump 10 for maintenance purposes.

The fixed portion 20 of the lift out coupling 19 is illustrated in FIG. 3 and includes the base support frame 22, preferably formed from cast iron and being epoxy coated with attachment holes 50 for anchor bolts 52 to hold the frame 22 in place on the base 23 of the sump 10 as shown in FIG. 1. A discharge elbow element 54 is cast integrally with the base frame 22 and has a threaded connection 56 extending upward for connection to discharge pipe 24 as shown in FIG. 1. Whereas the threaded connection 56 is shown as being an external thread for certain pipe sizes, an internal thread may be provided. The elbow element 54 has a fixed sealing flange 58 which has a substantially vertical mating face 59 for mating with a sealing flange of the lift out portion 18 of the lift out coupling 19. External arms 60 on both sides of the fixed sealing flange 58 extend outward toward the lift out portion 18 of the lift out coupling 19 and have tapered projections 62 which with the arms 60 form tapered slots 64 as illustrated in FIG. 1. On each side of the fixed sealing flange 58, and in the same plane, are locating guide rail pins 66 into which the two guide rails 32 fit and are retained. The positioning of the guide rails 32 is illustrated in FIGS. 1 and 2.

Figure 4:
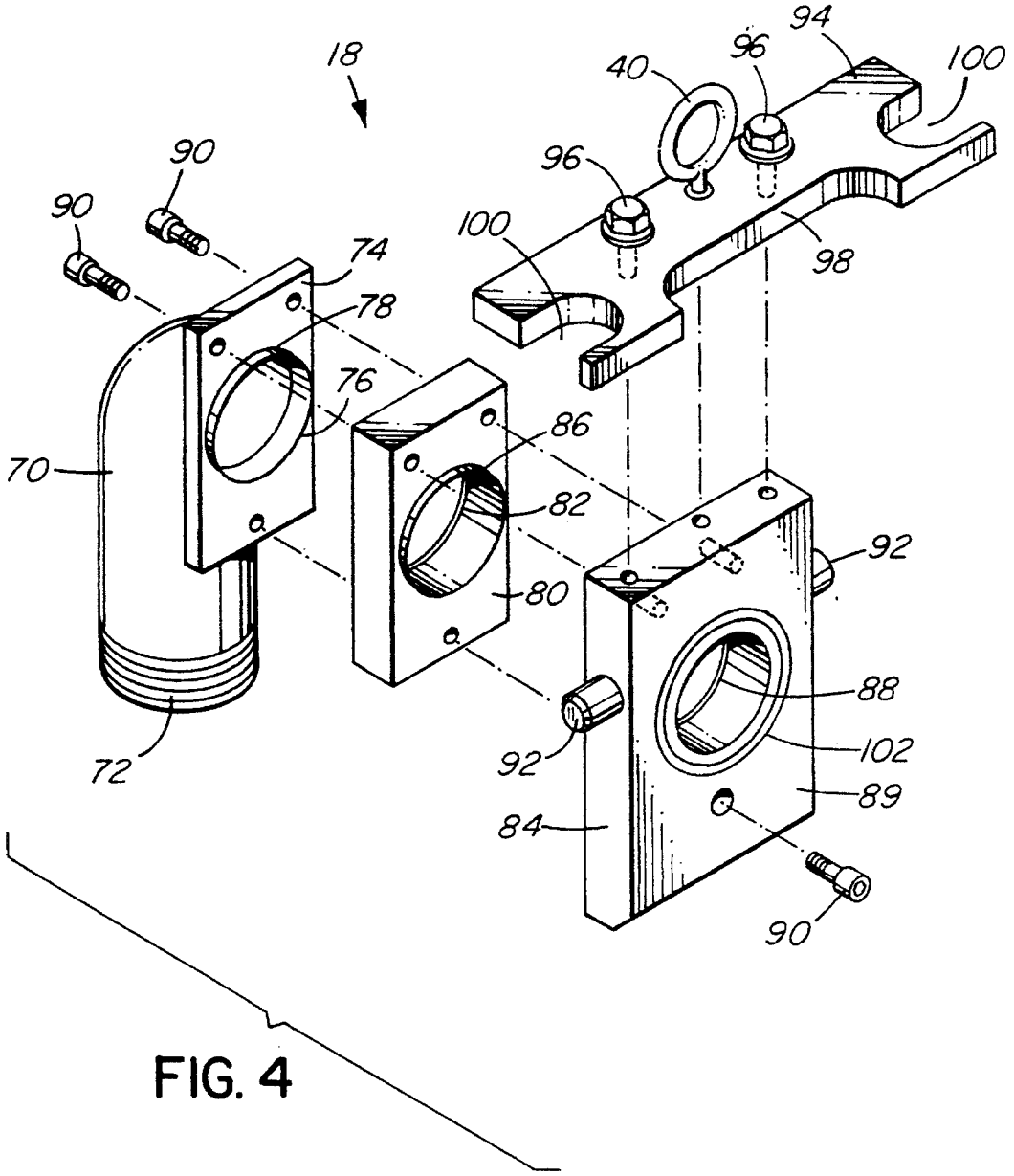
FIG. 4 is an exploded view showing one embodiment of the lift out portion of a lift out coupling according to the present invention.

The lift out portion 18 of the lift out coupling 19 is illustrated in FIG. 4 and comprises a close quarter elbow 70 with a threaded base 72 for insertion into an upward facing threaded discharge from the pump 14. Integral with the elbow 70 is a close quarter sealing plate flange 74 with a central sealing spigot 76 and an O-ring 78. The dimension of the combination close quarter elbow 70 and sealing plate flange 74 is such that it may easily be fitted to the threaded discharge of the pump 14 and rotated therein without interference with the pump 14 or motor 16. Thus, the close quarter elbow 70 may be reasonably short and does not extend up above the top of the motor 16. A spacer plate 80 mates with the sealing plate flange 74 and has an O-ring seat 82 to pass over the spigot 76 and seal with the O-ring 78, thus sealing the spacer plate 80 to the sealing plate flange 74. A pump carrier sealing flange 84 fits over a spacer plate spigot 86 on the spacer plate 80 and has an O-ring seal 88 on the pump carrier sealing flange 84 to ensure proper seal between the pump carrier sealing flange 84 and the spacer plate 80. The pump carrier sealing flange has a vertical mating face 89 to mate with the vertical mating face 59 of the fixed sealing flange 58. Allen head cap screws 90 are provided to hold the sealing plate flange 74, the spacing plate 80 and the pump carrier sealing flange 84 together. The top screw 90 is inserted from the close quarter elbow side and the bottom screw 90 being counter-sunk in the pump carrier sealing flange 84. Thus, the spacer plate 80 and pump carrier sealing flange 84 are joined to the close quarter sealing plate flange 74 after the close quarter elbow 70 has been fitted to the threaded discharge of the pump 14.

Described in more detail, the close quarter elbow shown in FIG. 4 includes a substantially straight cylindrical body **70*a* and an integral close quarter sealing plate flange 74 formed on body 70*a*** to be substantially tangential to the body.

Location pins 92 extend out from either side of the pump carrier sealing flange 84 and, as can be seen in FIG. 1, fit into the tapered slots 64 formed by the tapered projections 62 and the external arms 60 extending from the fixed sealing flange 58 of the fixed portion of the lift out coupling 19. A carrier guide plate 94 is attached to the top of the pump carrier sealing flange 84 by bolts 96 and has a front slot 98 to ensure that it is clear of all fittings. Two sliding grooves 100 are provided on each side of the carrier guide plate 94 to fit over the guide rails 32 and ensure that when the pump and lift out portion 18 of the coupling 19 are raised, they follow the guide rails 32 up to the top of the sump before being lifted out for maintenance.

On the vertical mating face 89 of the pump carrier sealing flange 84 is an O-ring seal 102 set in a groove about the aperture to ensure sealing occurs when the pump carrier sealing flange 84 mates with the fixed sealing flange 58 of the fixed portion 20 of the coupling 19.

The coupling members for different pipe sizes may be made substantially the same, having an aperture diameter of approximately 2". However, the close quarter elbow 70 of the lift out portion 18 and the elbow element 54 of the fixed portion 20 may have threaded ends for 1¼", 1½" or 3" pipe size, depending upon the requirements.

In operation the weight of the pump 14 and lift out portion 18 of the coupling 19 are sufficient to slide lift out portion 18 along guide rail 32 unit lift out portion 18 is stopped by fixed portion 20. Thus, close quarter sealing plate flange 74 is operatively connected to sealing flange 58 of fixed portion 20. This connection is improved by the weight of pump 14 and lift out portion 18 which create pressure between the locating pins 92 on the pump carrier sealing flange 84 against the tapered projections 62 of the fixed portion 20 so that a seal occurs between mating faces of the flanges 58,89 and also to support the full weight of the pump 14 and motor 16. As shown in FIG. 1, a space is provided underneath the pump to prevent debris forming an obstruction to prevent the pump from reaching the bottom of the sump and thus preventing a proper mating of the coupling flanges.

Figure 5:
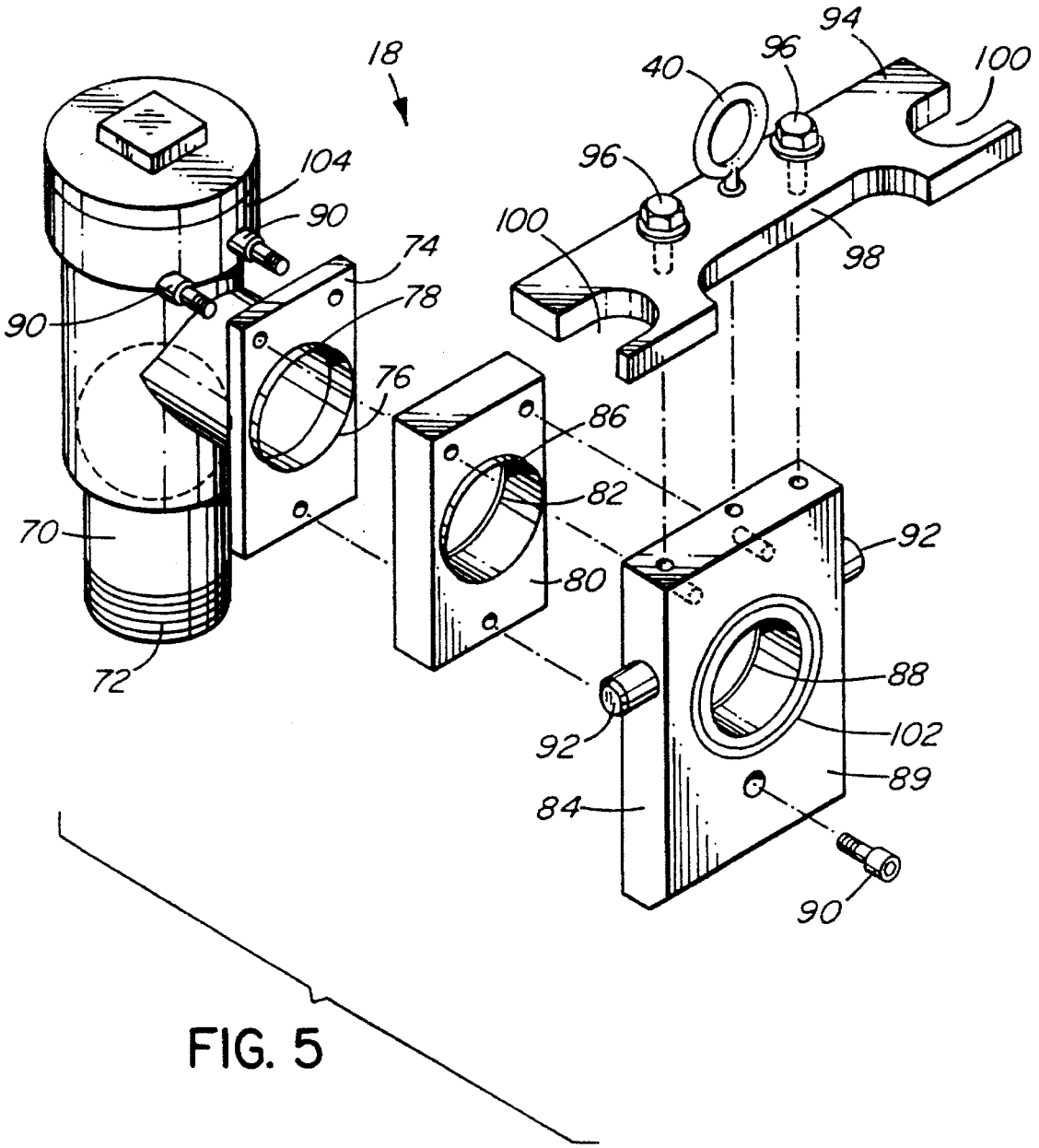
FIG. 5 is an exploded view showing another embodiment of a lift out portion of a lift out coupling similar to that shown in FIG. 4 and having a non-return valve therein.

Another embodiment of the lift out portion 18 of the coupling is shown in FIG. 5 wherein the close quarter elbow 70 has a non-return valve 104 incorporated therein. The elbow 70 is still integral with the close quarter sealing plate flange 74. The dimensions of the combined close quarter elbow 70, non-return valve 104 and the sealing plate flange 74 are such that they can be rotated for the screw threads 72 to engage in the threaded discharge of the pump 14 without interference with the pump 14 or motor 16. As most pumps have standard dimensions, the close quarter elbow arrangement has been designed to fit all of the standard pumps regardless of the threaded discharge pipe size.

Whereas the close quarter elbows 70, illustrated in FIGS. 4 and 5, have been shown to have external threads 72, for the smallest diameter of pipe, namely 1¼ diameter pipe, it is more normal to have an internal thread which engages on a threaded pipe connection fitted to the discharge outlet of the pump 14.

Various changes may be made to the embodiments shown herein without departing from the scope of the invention which is limited only by the following claims.

The embodiments of the present invention in which an exclusive property or privilege is claimed are defined as follows:

1. A lift out coupling for a submersible pump with an upward facing threaded discharge, the coupling comprising:

a lift out portion including a pump outlet close quarter elbow for connection to the threaded discharge and rotatable without interfering with the submersible pump, the elbow having a first sealing flange connected thereto with lifting guide means and attachment means for raising the pump and the lift out portion on guide rails;

a fixed portion including a second sealing flange for mating with the first sealing flange, the second sealing flange connected to a discharge elbow forming part of a base support frame for installation in a sump, the frame having the guide rails extending upward therefrom in the sump, and connection means between the lift out portion and the fixed portion of the coupling to support the lift out portion and the pump and retain the first sealing flange sealed to the second sealing flange.

2. The lift out coupling according to claim 1 wherein the attachment means includes a lifting eye bolt on top of the first sealing flange.

3. The lift out coupling according to claim 1 wherein the lifting guide means comprises a carrier plate attached to the top of the first sealing flange, the carrier plate having grooves to contain guide rails and permit the lift out portion to be raised and lowered whilst maintaining the guide rails in the grooves.

4. The lift out coupling according to claim 1 wherein the base support frame has anchoring means for anchoring the frame to a sump base and at the same time ensuring that the pump is positioned above the sump base when the two sealing flanges are connected.

5. The lift out coupling according to claim 1 wherein the lift out portion has the pump outlet close quarter elbow of a sealing plate flange integral therewith and has a spacer plate positioned between the sealing plate flange and the first sealing flange, the spacer plate having a thickness to ensure clearance between the pump and the base support frame when the two sealing flanges are connected.

6. The lift out coupling according to claim 1 wherein the pump outlet close quarter elbow of the lift out portion has a sealing plate flange integral therewith and separate from the first sealing flange, the pump outlet close quarter elbow having a threaded connection to the upward facing threaded discharge from the pump, the pump outlet close quarter elbow extending only a short distance permitting rotation of the elbow during installation into the threaded outlet.

7. A lift out coupling for a submersible pump with an upward facing threaded discharge the coupling comprising:

a lift out portion including a pump outlet close quarter elbow for connection to the real discharge and rotatable without interfering with the submersible pump the elbow having a first sealing flange connected thereto with lifting guide means and attachment means for raising the pump and the lift out portion on guide rail a fixed portion including a second sealing flange for mating with the first sealing flange, the second sealing flange connected to a discharge elbow forming part of a base supportable for installation in a sump, having the guide rails extending upward therefrom in the sump: and connection means between the lift out portion and the fixed portion of the coupling to support the lift out portion and the pump and retain the first sealing flange sealed to the second sealing flange, wherein the connection means comprises pins projecting from opposing sides of the first sealing flange, the pins engaging in tapered slots of arms extending from the base support frame on opposing sides of the second sealing flange, such that weight of the pump and the lift out portion of the coupling pushes the pins inward in the tapered slots so the two sealing flanges mate and seal.

8. A lift out coupling for a submersible pump with an upward facing threaded discharge the coupling comprising:

a lift out portion including a pump outlet close quarter elbow for connection to the threaded discharge and rotatable without interfering with the submersible pump, the elbow having a first sealing flange connected thereto with lifting guide means and attachment means for raising the pump and the lift out portion on guide rails, and further including a non-return valve incorporated in the pump outlet close quarter elbow;

a fixed portion including a second sealing flange for mating with the first sealing flange, the second sealing flange connected to a discharge elbow forming part of a base support frame for installation in a sump having the guide rails extending upward therefrom in the sump: and connection means between the lift out portion and the fixed portion of the coupling to support the lift out portion and the pump and refrain the first sealing flange sealed to the second sealing flange.

9. A lift out coupling for removably interconnecting an upward facing threaded discharge of a pump to a discharge pipe, the coupling comprising:

a fixed portion including a sealing flange operatively connected to the discharge pipe and fixed to a guide rail extending upward therefrom; and a lift out portion including a pump outlet close quarter elbow for connection to the threaded discharge, the close quarter elbow including:

a substantially straight cylindrical body;

an integral close quarter sealing plate flange formed on the body to be substantially tangential to the body; and a guide for slidably interfacing with the guide rail;

wherein the close quarter sealing plate flange is operatively connected to the sealing flange of the fixed portion when the guide is interfaced with the guide rail and the lift out portion is slid along the guide rail until the lift out portion is stopped by the fixed portion.

10. The lift out coupling according to claim 9, further comprising:

pins attached to and projecting from opposing sides of the lift out coupling; and arms attached to and extending from the fixed portion, and having tapered slots for engaging the pins, such that the weight of the pump and the lift out portion of the coupling pushes the pins inward in the tapered slots so the lift out portion is forced towards the fixed portion.

11. The lift out coupling according to claim 9 further comprising a lifting eye bolt on top of the close quarter elbow.

12. The lift out coupling according to claim 9 wherein the guide comprises a carrier plate attached to the top of the close quarter elbow, the carrier plate having grooves to contain guide rails and permit the lift out portion to be raised and lowered whilst maintaining the guide rails in the grooves.

13. The lift out coupling according to claim 9 further comprising a base support frame having anchors for anchoring the frame to a sump base and at the same time ensuring that the pump is positioned above the sump base when the two sealing flanges are operatively connected.

14. The lift out coupling according to claim 9 further comprising a non-return valve incorporated in the pump outlet close quarter elbow.

15. The lift out coupling according to claim 9 further comprising a pump carrier attached to the close quarter sealing flange and having a pump carrier sealing flange for operative connection to the sealing flange of the fixed portion, the pump carrier having a thickness to ensure clearance between the pump and the base support frame when the lift out portion is operatively connected to the fixed portion.

16. The lift out coupling according to claim 15 further comprising:

pins attached to and projecting from opposing sides of the pump carrier; and arms attached to and extending from the fixed portion, and having tapered slots for engaging the pins, such that the weight of the pump and the lift out portion of the coupling pushes the pins inward in the tapered slots so the lift out portion is forced towards the fixed portion.

* * * * *